United States Patent [19]

Oder et al.

[11] 4,073,554

[45] Feb. 14, 1978

[54] MODULAR SAFETY DEPOSIT BOX SYSTEM

[75] Inventors: Charles D. Oder; Harold G. Doehlman, both of Hamilton, Ohio

[73] Assignee: The Mosler Safe Company, Hamilton, Ohio

[21] Appl. No.: 733,053

[22] Filed: Oct. 18, 1976

[51] Int. Cl.[2] ..... A47B 53/00; A47B 87/00

[52] U.S. Cl. ..... 312/199; 312/111; 312/292; 109/53

[58] Field of Search ..... 312/199, 292, 111; 109/53, 56, 57

[56] References Cited

U.S. PATENT DOCUMENTS

| | | | |
|---|---|---|---|
| 640,315 | 1/1900 | Parmelee | 312/199 |
| 1,241,279 | 9/1917 | Pyle | 109/53 |
| 1,241,615 | 10/1917 | Farrow | 312/199 |
| 1,646,492 | 10/1927 | Rauchbach | 312/199 |
| 1,726,121 | 8/1929 | Polkosnik | 312/111 |
| 1,779,218 | 10/1930 | Schmalzgruber | 312/199 |
| 1,984,977 | 12/1934 | Mize | 312/292 |
| 2,011,962 | 8/1935 | Wheatley | 312/111 |
| 3,837,299 | 9/1974 | McClellan | 109/53 |
| 3,848,942 | 11/1974 | Fanini | 312/111 |
| 3,970,010 | 7/1976 | Cantley | 109/56 |

FOREIGN PATENT DOCUMENTS

| | | | |
|---|---|---|---|
| 556,047 | 2/1957 | Italy | 312/292 |

*Primary Examiner*—Paul R. Gilliam
*Assistant Examiner*—Victor N. Sakran
*Attorney, Agent, or Firm*—Wood, Herron & Evans

[57] ABSTRACT

An improved modular type safety deposit box system. In preferred form, each module is comprised of the same basic casing structure, and an initially separate door frame structure, these two components then being assembled into a completed module after pre-assembly of each component. Each module's casing may be subdivided into more than one compartment by use of a plurality of standardized horizontal dividers and, if desired, standardized vertical dividers, the dividers being arranged as desired in operative engagement with the casing through a slot and tab structure. Each module's door frame is comprised of a hoop-shaped frame adapted to be subdivided into a plurality of access ports corresponding to the same number of compartments provided in the basic casing. The doors for each access port of the frame may be installed to hinge from one side of the frame if no vertical dividers are used in the casing, or from a center hinge post fixed in the frame if vertical dividers are used in the casing. The modules are retained together in a matrix-like system one on top another, as well as one adjacent to another, by a series of vertical interlocking bars adapted to connect together adjacent columns of modules stacked one on top another.

11 Claims, 10 Drawing Figures

MODULAR SAFETY DEPOSIT BOX SYSTEM

This invention relates to safety deposit box systems. More particularly, this invention relates to an improved modular type structure for a safety deposit box system.

Safety deposit box systems are, of course, very well known to the prior art. By far the majority of bank offices in this country, main office as well as branch office, are provided with a plurality of individual safety deposit boxes within their vaults. Of course, safety deposit boxes are used by customers to hold valuable papers such as stock certificates or bonds, as well as tangible person property such as jewels or family heirlooms, or the like. Thus, the use of safety deposit box systems services an important customer market in the banking industry.

The manufacture and installation of a safety deposit box system has heretofore been beset by a couple of practical problems inherent in the nature of that system. First, a plurality of different box sizes must be provided in a safety deposit box system, e.g., extra small boxes, small boxes, medium boxes, medium large boxes, large boxes, etc. Such is, of course, necessary since different rental rates are charged for different sized boxes, and since the box size requirements will vary between customers within that customer area serviced by the office or branch where the safety deposit box vault is located. Second, the manufacture and installation of a safety deposit box system has been one requiring skilled craftsmen at the installation site. This for the reason that, generally speaking, substantial customfit type work is required in the installation of a safety deposit box system within the bank's vault area. This is particularly the case in connection with the fitting of doors to the various box compartments, such being required so that the doors do not stick, bind or otherwise malfunction during use by the customer.

Accordingly, it has been a primary objective of this invention to provide an improved modular safety deposit box system in which a single modular basic casing structure is employed, the width of that basic casing being no wider than the width of the widest compartment in the system.

It has been another objective of this invention to provide an improved modular safety deposit box system in which a single basic casing structure is used in combination with an initially separate door frame structure, the casing being pre-assembled with the desired number of box compartments and the frame being pre-assembled with a number of access ports equal to the number of compartments provided in the related casing, and the casing and door frame components being assembled into a completed module after pre-assembly of each component.

It has been still a further objective of this invention to provide an improved modular safety deposit box system in which a novel door frame structure is incorporated with a novel basic casing structure, that door frame structure including means that cooperate to retain the modules in a mating-like system one on top another, as well as one adjacent to the other, by interlocking adjacent columns of modules stacked one on top another.

In accord with the objectives of this invention, and in preferred form, each module is comprised of the same basic casing structure, and an initially separate door frame structure, these two components then being assembled in a completed module after pre-assembly of each component. Each module's casing may be subdivided into more than one compartment by use of a plurality of standardized horizontal dividers and, if desired, standardized vertical dividers, the dividers being arranged as desired in operative engagement with the casing through a slot and tab structure. Each module's door frame is comprised of a hoop-shaped frame adapted to be subdivided into a plurality of ports corresponding to the same number of compartments provided in the basic casing. The doors for each access port of the frame may be installed to hinge from one side of the frame if the vertical dividers are used in the casing, or from a center hinge post fixed in the frame if vertical dividers are used in the casing. The modules are retained together in a matrix-like system one on top another, as well as one adjacent to another, by a series of vertical interlocking bars adapted to connect together adjacent columns of modules stacked one on top another.

Other objectives and advantages will be more apparent from the following detailed description taken in conjunction with the drawings in which.

Figure 1:
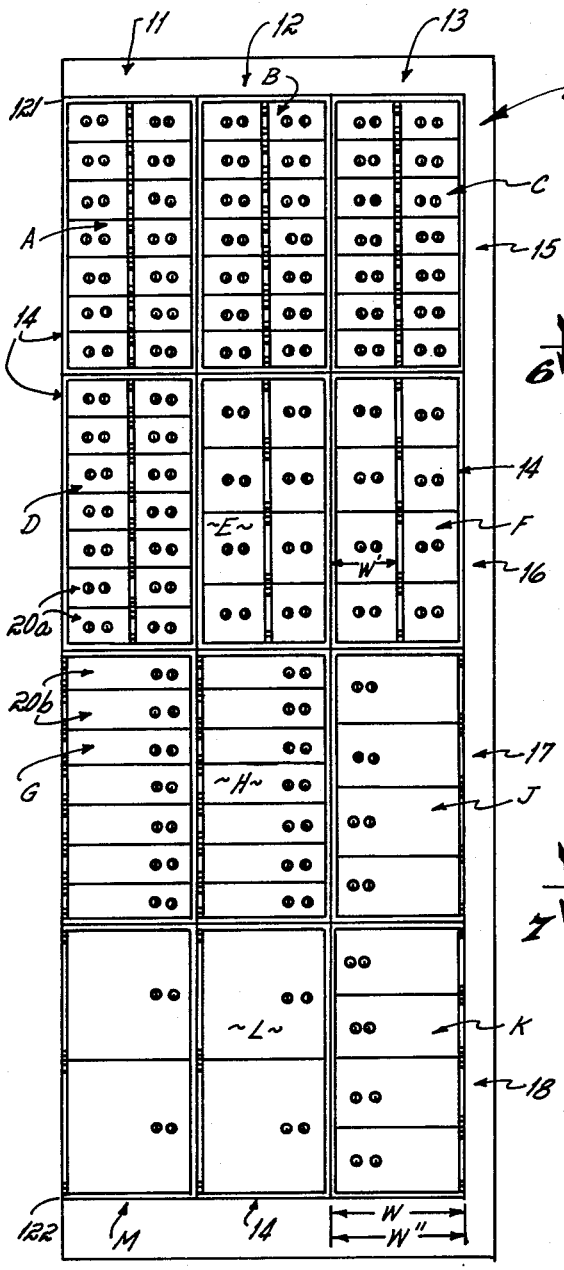
FIG. 1 is a front view illustrating an improved modular safety deposit box system in accord with the principles of this invention.

The improved modular safety deposit box system 10 of this invention is illustrated in FIG. 1. As shown in that Figure, the system 10 is comprised of three columns 11, 12, 13 of modules, each column being provided with four modules 14 stacked one on top the other, and all the modules being of the same exterior size and exterior geometrical configuration relative to all other modules. In other words, the system 10 is laid out in matrix fashion with each column 11–13 of the matrix being comprised of four modules 14, and each row 15, 16, 17, 18 of the matrix also being comprised of three modules 14, the modules 14 being identical one to the other except for the number of compartments 19 (and, hence, number of doors 20) defined by each. The top two rows 15, 16 of modules 14 are comprised of modules **14*a* each of which defines a plurality of compartments 19*a* having a width W′ essentially one-half the width W of the module 14*a*. In other words, the safety deposit box compartment doors 20*a* for modules 14*a* are essentially one-half the width of the module's width W. In this module 14*a* embodiment, the safety deposit box doors 20a are hinged along a vertical hinge line 21 parallel to and spaced equidistantly between the side walls 22 of the module. The bottom two rows 17, 18 of modules 14 are comprised of modules 14b each of which defines a plurality of compartments 19b having a width W″ essentially equal to the width W of the module 14b. In the instance of these modules 14b, the safety deposit box compartment doors 20b on each of the modules 14b are hingedly mounted on a hinge line 23 which is coextensive, i.e., essentially in the plane of, one side wall 22 of the module 14b. More specifically, and within the module 14a type, modules A, B, C, D are divided into fourteen separate compartments 19a; and in connection with modules E and F, same are subdivided into eight separate compartments 19a. In the case of the module 14b type, modules G and H are subdivided into seven separate compartments; in connection with modules J and K, same are subdivided into four separate compartments; and in the case of modules L and M, same are subdivided into two separate compartments. It is the structure which permits the subdivision of these modules into the number of compartments desired at the production source which constitutes a part of the subject matter of this invention, and which is illustrated in detail in the other Figures. Thus, and in this particular modular safety deposit box system 10, it will be apparent that a single basic module size is used for each of the types of modules 14a, 14b within the system, the modules being structured to define a plurality of different box compartment sizes. Within this modular box system 10, no module 14a or 14b width is greater than the compartment 19a or 19b width within that system, and in this connection in some of the modules 14a the compartments 19a are of essentially one-half the width of the module. This permits the modules 14 to be relatively small in overall size after manufacture, thereby limiting the degree of module distortion likely between factory and field installation sites. Further, the smaller the module 14** the less its weight when completed, thereby permitting same to be handled and installed easier at the field installation site.

Figure 2:
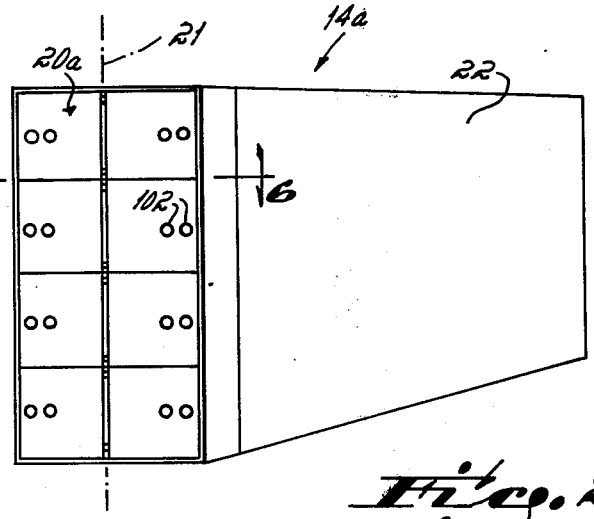
FIG. 2 is a frontal perspective view illustrating one type module from the system shown in FIG. 1, that module including a plurality of compartments each having a width one-half the width of the module.
Figure 3:
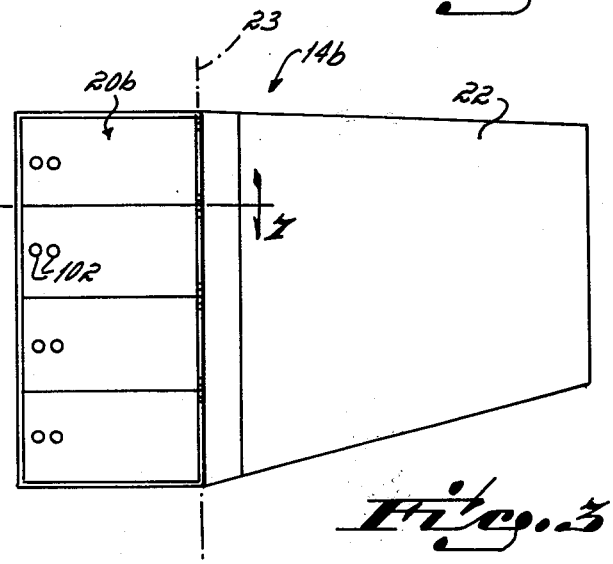
FIG. 3 is a frontal perspective view similar to FIG. 2 but of a second type module, that module including a plurality of compartments each having a width equal to the width of the module.

The novel safety deposit box module 14a, 14b structure of this invention is illustrated in FIGS. 2–10. Basically, two different types 14a and 14b of module structures are employed. Both basic types 14a and 14b of module structures employ the same basic casing 30 structure, but employ different structurally rigid door frame 31 structures. In this connection, and as illustrated in FIG. 2, one type of module 14a structure provides multiple box compartments 19a each of a width W′ about one-half the width W of the module; in this type modular structure, the compartment doors 20a are hingedly mounted on a single hinge line 21 centrally located between and parallel to the side walls 22 of the module 14a. The second type of module 14b structure is that where each box compartment 20b is of a width W″ essentially equal to the width W of the module; in this type modular structure, the compartment doors 20b are hingedly mounted on a hinge line 23 essentially coextensive with one side wall 22 of the module. The double door 20a type module structure shown in FIG. 2 is illustrated in greater detail in FIGS. 4 and 6, and the single door 20b type module structure shown in FIG. 3 is illustrated in greater detail in FIGS. 5 and 7.

Figure 4:
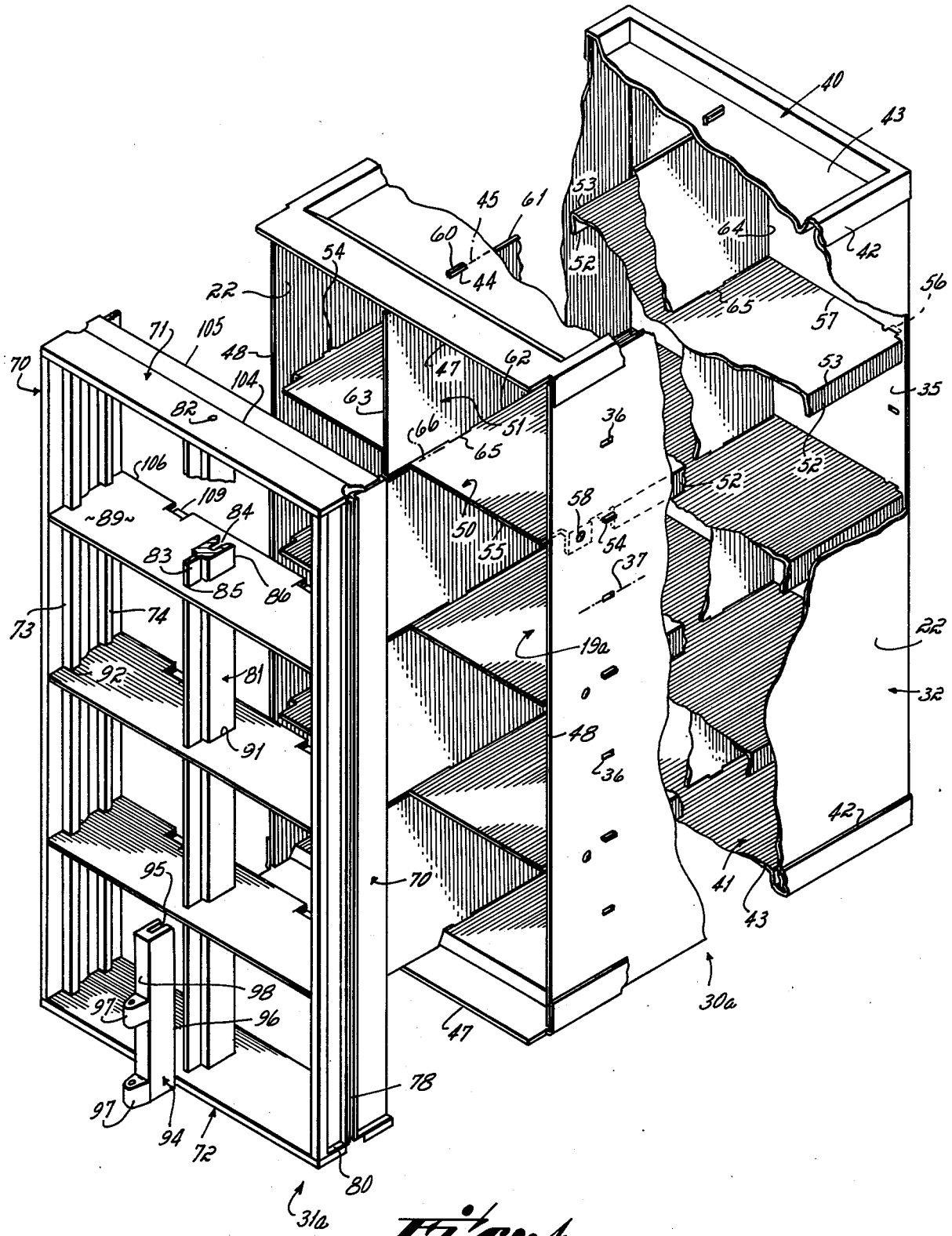
FIG. 4 is a blown-up and partially broken away perspective view of that module illustrated in FIG. 2.
Figure 5:
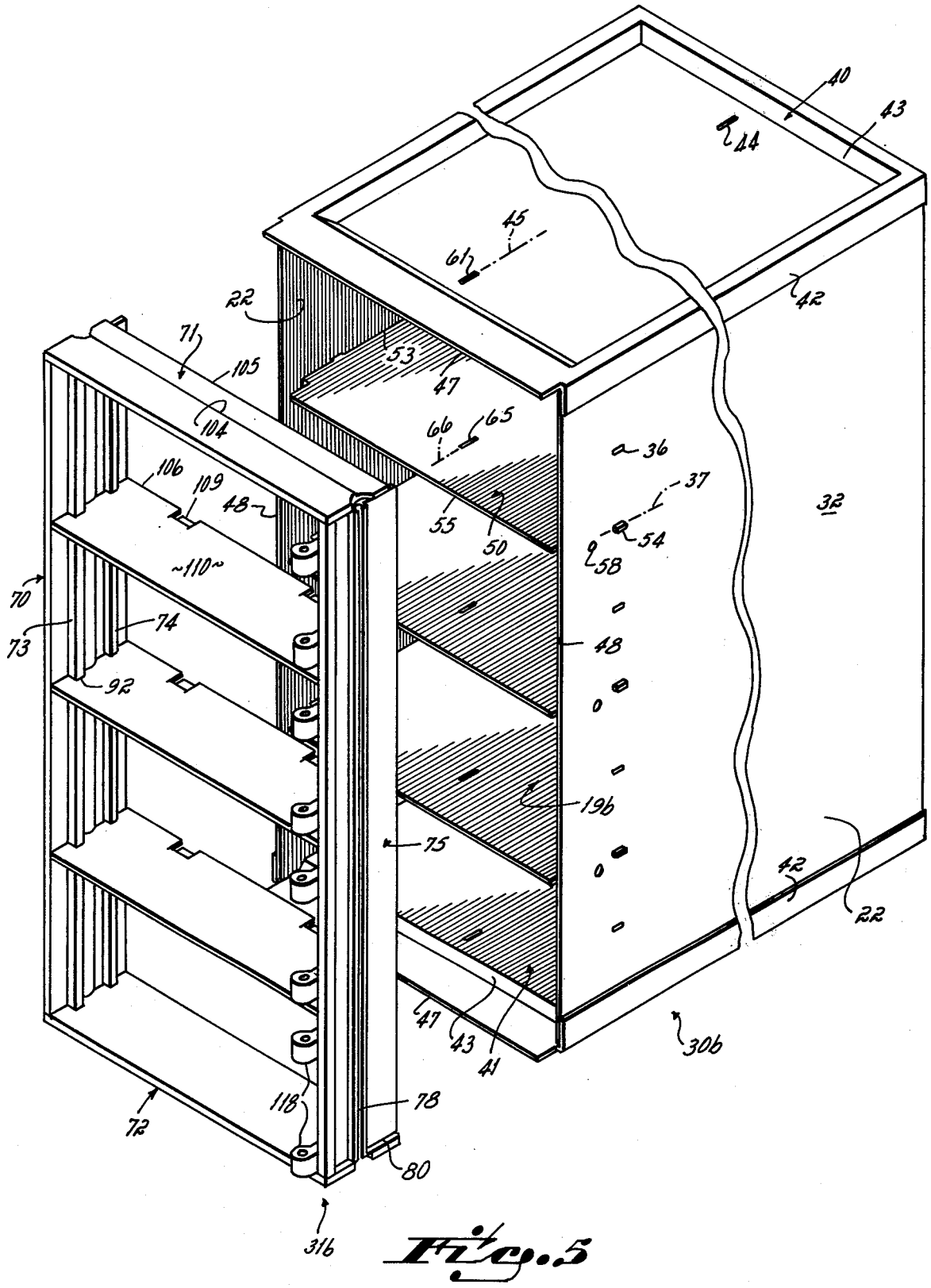
FIG. 5 is a blown-up and partially broken away perspective view of that module illustrated in FIG. 3.

As previously mentioned, the basic casing 30 of each module 14a and 14b is identical to each of the other modules. This, as will be appreciated by those skilled in the art, results in efficient and economical usage of materials and assembly time in the initial production of the modules. As illustrated in FIGS. 4 and 5, the basic casing 30 includes a U-shaped (in top view) side wall/rear wall component 32 which includes spaced side walls 22—22 connected by rear wall 35. The side wall/rear wall casing component 32 is provided with a plurality of slots 36 along horizontal slot lines 37 on the side walls 22—22 and rear wall 35 thereof. The slots 36 at each vertical level of the side wall/rear wall component 32, i.e., in the side walls 22—22 and rear wall 35 of the casing 30 at a predetermined level, cooperate to define a slot plane that is horizontal to floor level of the module 14. Thus, the slot lines 37 define a series of spaced horizontal planes relative one to the other. The number of phantom planes defined by the horizontal slot lines 37 is at least equal to the maximum number of box compartments, from top to bottom of the basic casing 30, desired in the module 14.

Top 40 and bottom 41 caps, each of identical configuration and dimensions relative one to the other, are positioned on and fixed to the top and bottom of the side wall/rear wall element 32 so as to provide the basic casing 30 as an integral unit, see FIGS. 4 and 5. Each of the top 40 and bottom 41 caps is provided with an annular flange 42 around three sides thereof that fits over the exterior surface of element 32, and a depressed interior section 43. The depressed interior section 43 is provided with a plurality of slots 44 on a single slot line 45 equidistantly spaced between and parallel to the side flanges 42 of the caps 40 and 41. The leading edge 47 of both the top 40 and bottom 41 caps is sized to extend over the leading edges 48 of the casing's side walls 22 across the width of the casing 30 when the caps are assembled with the side wall/rear wall element 32.

The number of shelves 50, and the number of center dividers 51, installed within the basic casing 30 is dependent upon which type 14a or 14b of module is desired, and on the number of box compartments 19 desired within that module, i.e., upon which module A–M structure is desired. Two different embodiments, one illustrating use of vertical dividers 51 and shelves 50, and one with shelves 50 only, are illustrated in FIGS. 4 and 5, respectively. As shown in FIGS. 4 and 5, three shelves 50 are mounted within the basic casing 30, thereby providing four primary compartments. Each of the shelves 50 is provided with a depending lip 52 along each side edge 53 thereof, a front tab 54 extending outwardly from the edge 53 of the shelf on each side thereof adjacent the leading edge 55 thereof, and a rear tab 56 extending outwardly from the rear edge 57 thereof on each side thereof, all as shown in FIG. 4. The tabs 54, 56 are adapted to be received within the slots 36 defined in the relevant phantom planes defined by slot lines 37 previously mentioned, thereby locating each of the shelves in three separate and evenly spaced locations within the basic casing 30. The shelves 50 are installed within the casing simply by flexing same until the tabs 54, 56 are received in the respective slots 36. After each of the shelves 50 is so located, same may be riveted if desired by installing a rivet 58 to hold the casing's side wall 22 in fixed position with the shelf's depending flange 52 on each side of the shelf.

Note the rivets 58 and tabs 54, 56 do not extend beyond the exterior face of the casing's side walls 22 a distance greater than the thickness of the top 40 and bottom 41 caps' flanges 42, thereby retaining a cubic configuration for the casing 30 without any protrusion therefrom.

In that module 14b embodiment where the width W″ of the box compartments 19b is essentially equal to the width W of the module itself, only shelves 50 are used as shown in FIG. 5. Hence, the casing 30b in FIG. 5 is ready for assembly with its associated door frame 31b. However, and when it is desired to further modify a module 14 so that the width W′ of the box compartments 19a is about equal to one-half of the width W of the module 14a, vertical panels 51 are introduced between shelves 50 as illustrated in FIG. 4. The vertical panels 51 are aligned coplanar one with another, that coplanar series of panels being centrally disposed in parallel fashion between the side walls 22 of the casing 30a. Note the vertical panels 51 extend beyond leading edges 55 of shelves 50 (and, hence, of sidewalls, too) to provide leading edges 63 coplanar with leading edges of the caps 40, 41. Each of the vertical central panels 51 is provided with a pair of tabs 60 along the top 61 and bottom 62 edges thereof, each pair having one tab adjacent the front edge 63 of the panel and one tab adjacent the rear edge 64 of the panel. The tabs 60 interrelate with slots 44 provided in the top 40 and bottom 41 caps of the casing 30a, as well as within slots 65 provided in the intermediate shelves 50 of the casing. The slots 65 within the shelves 50 are provided in all shelves, whether dividers 51 are used in the casing 30 or not, those slots 65 being on a slot line 66 disposed parallel to and midway between side edges 53 of the shelves. The vertical dividers 51 are interposed into position with shelves 50 and caps 40, 41 by flexing of same, as was the case with installation of the shelves 50 with the casing's side walls 22. From this description of the basic casing 30, it will be seen that mass production is readily available in that only a single shelf 50 structure, a single vertical panel 51 structure, and a single casing 30 structure need be produced to permit assembly of different modules A–M having various numbers of box compartments 19 therein depending upon the desires of the customer.

Figure 6:
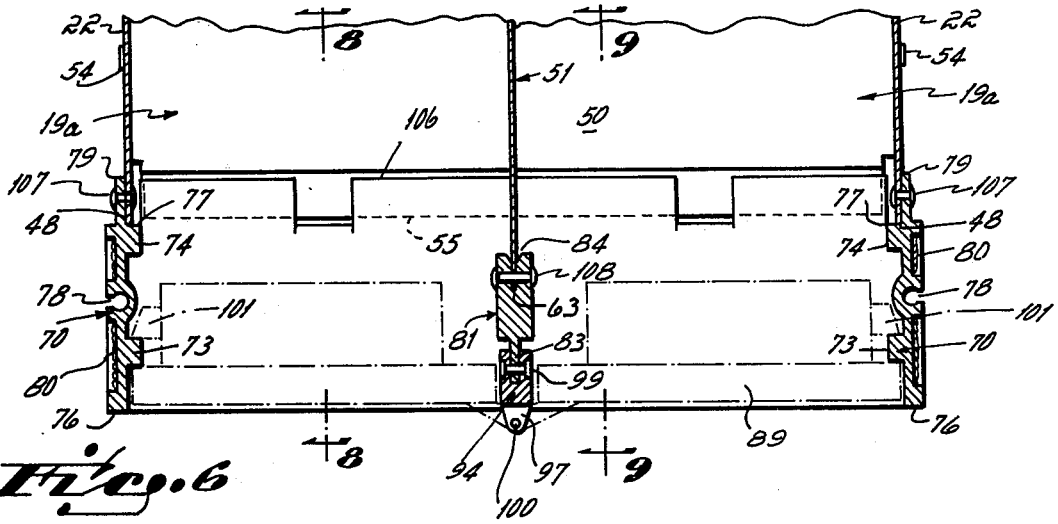
FIG. 6 is a cross-sectional view taken along line 6—6 of FIG. 2.

That door frame 31 adapted for use with that module 14a where the box compartments 19a are of a width W′ about equal to one-half the width W of the module, i.e., modules A–F of that type module shown in FIG. 2, is illustrated particularly in FIGS. 4 and 6. As shown in those Figures, the door frame 31 includes opposed structurally rigid jamb or side members 70 joined together by structurally rigid header 71 and sill 72 members. The jambs 70, as illustrated particularly in FIG. 6, are extruded members, and are configured to define an internally disposed strike plate rib 73 that extends from header 71 to sill 72 of each jamb. Midway between the leading 76 and trailing 77 edges of each jamb 70 there is defined a bolt notch 78 on the exterior face of the jamb, see FIG. 6. Each jamb 70 also includes a tongue 79 which extends along its trailing edge 77 of the jamb from header 71 to sill 72, the tongue extending out generally coplanar with the plane of the jamb, see FIG. 6. The jambs 70 are welded to the header 71 and sill 72 of the door frame 31a. Note that, as particularly illustrated in FIG. 4, when the jambs 70 are squared in the corners with the header 71 and sill 72, that fillets 80 are cut out along the end edges of the header and sill. It is in these fillets that the welds are established so as to retain the right angular nature of the corners of the door frame 31a, i.e., to prevent a weld bead or tack weld from extending out of the exterior peripheral planes of the frame. This, of course, permits the modules to be located in flush relation one with another in stacked configuration as illustrated in FIG. 1. This basic frame 30a structure just described is common to both module 14a and module 14b, the only difference therein being the structural configuration of jamb 75 as discussed below in connection with the frame for module 14b, compare FIGS. 6 and 7.

As previously mentioned, the door frame 30 illustrated in FIG. 4 is adapted for use with safety deposit box doors 20a of a width W′ about one-half of the width W of the module 30a. In this connection, a single centerpost 81 is positioned horizontal to the jambs 70 and midway therebetween. The centerpost 81 is welded to the header 71 and sill 72 of the frame 31a by plug welds 82. Note particularly that the centerpost is of a tongue 83 and groove 84 construction, the tongue being exposed on the front edge 85 thereof and the groove on the rear edge 86 thereof, each extending from the header 71 to the sill 72. Port plates 89 are positioned within the frame 31a, the port plates cooperating with centerpost 81 to define a number of access ports therein equal in number to the number of compartments 19a within the casing 30a. Each port plate 89 includes a hole 91 in the center thereof, the hole 91 being of the same geometry as that of the centerpost 81. The port plates 89 are positioned along the centerpost 81 at levels corresponding to the levels of shelves 50 within the casing 30a so that respective port plates and shelf pairs will be coplanar after assembly. Each side edge 92 of these port plates 89 are conformed in configuration to the ribs 73, 74 on the inner face of the jambs 70, thereby holding the port plates in front-to-rear position relative to the jambs after installation of the door frame 31a with the casing. The port plates 89 are tack welded to the centerpost 81 and to the jambs 70 to fix same in assembly with the door frame 31a.

A grooved hinge post section 94 is adapted to be mounted on the tongue 83 on the centerpost 81 as shown in FIG. 4, the combined hinge posts 94 defining hinge line 21, see FIG. 2. The hinge post 94 is provided with a groove 95 on the rear edge 96 thereof, and with pin blocks 97 on the front edge 98 thereof. Note that each hinge post 94 is connected with the centerpost's tongue 83 by rivets 99, see FIG. 6, thereby positively locating same in an immobile fashion with the door frame 31a, pairs of the doors 20a are then fitted to the hinge blocks 97 with pins fixed to the doors being inserted into apertures 100. Each door 20a is, of course, sized to close access port (and, hence, a box compartment 19a), the door being provided with retractable bolt 101 that cooperates with strike ribs 73, and with dual locks 102, the bolt and lock being of any structure known to the art.

After pre-assembly of the basic casing 30a and door frame 31a (and before or after doors 20a are installed on door frame 31a), these pre-assembled components are then assembled one with another into the final module 14a structure. As illustrated in FIGS. 4, 6, 8 and 9, the header 71 and sill 72 (not shown for sill, but same as for header) of the door frame 31a define recesses or seats 104 along the rear edges 105 thereof, and the rear edges 105 thereof are recessed from, i.e., do not extend outwardly coplanar with, rear edges 77 of the jambs 70. This recessed seat 104/tongue 77 structure of the door frame 31a permits the door frame's tongues or trailing edge 77 on opposed jambs 70 to overlie the side walls 22 of the casing 30a when the two are in assembled relation, and permits the leading edge 47 of the casing's top 40 and bottom 41 caps to be seated in the recesses 104 defined along the trailing edges of the header 71 and the sill 72. In fixed assembly, connector means in the form of rivets 107 are used to positively interconnect the header 71 and top cap 40 (see FIG. 8), the sill 72 and bottom cap 41 (not shown but identical in structure to that shown in FIG. 8), and also to interconnect the jambs' tongues 77 with the casing's side walls 22, see FIGS. 6 and 9, thereby positively interconnecting the door frame 31*a* with the casing 30*a*. Further, and upon telescoped assembly of the door frame 31*a* with the casing 30*a* as just described, the leading edges 63 of the vertical dividers 51 are received in groove 84 of the door frame's centerpost 81. Again, rivets 108 are used to positively interconnect the centerpost 81 with the vertical dividers 51 as illustrated in FIG. 6, thereby positively connecting the dividers 51 with the door frame 31*a* as well. Also in this connection, the rear edge 106 of each of the door frame's port plates 89 is provided with spaced depressed tabs 109 therealong. The tabs 109 cooperate with the leading edges 55 of the casing's shelves 50 upon assembly of the door frame 31*a* with the casing 30*a*. This tab 108/shelf 50 functional interrelation serves to maintain the door frame's port plates 89 and the casing's shelves 50 in respective coplanar relation one with the other after assembly of the frame 31*a* with the casing 30*a* and during use thereof. No rivets are used at this alignment type joint so as to maintain the smooth planar relation of the port plates 89 with the respective shelves 50.

Figure 7:
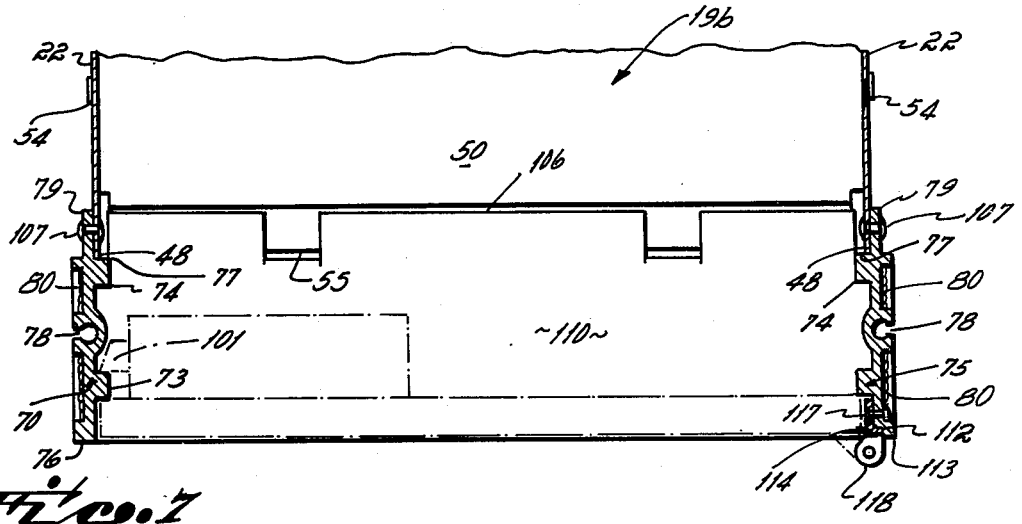
FIG. 7 is a cross-sectional view taken along line 7—7 of FIG. 3.
Figure 8:
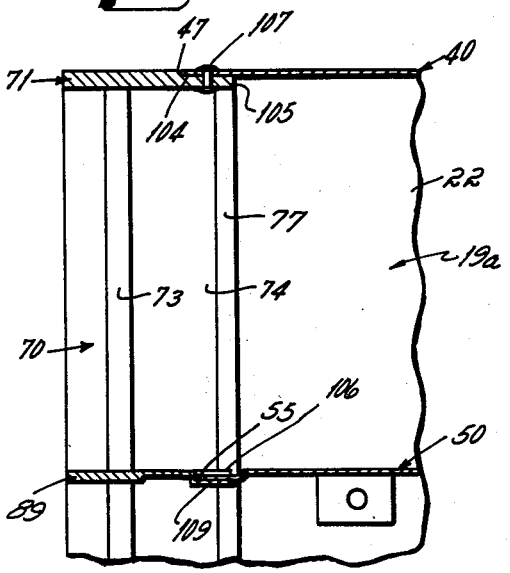
FIG. 8 is a cross-sectional view taken along line 8—8 of FIG. 6.
Figure 9:
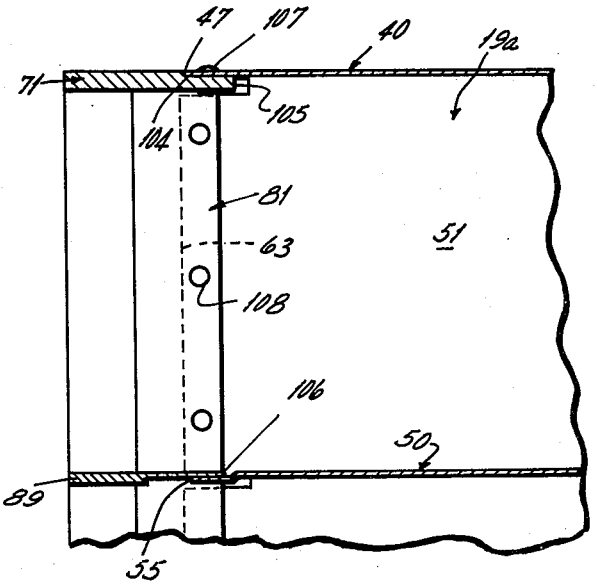
FIG. 9 is a cross-sectional view taken along line 9—9 of FIG. 6.

In connection with that type module 14*b* where the width W" of each box compartment 19*b* is essentially the same as the width W of the module, the door frame 30*b* structure for same is illustrated in FIGS. 5 and 7. As shown in those Figures, the header 71, sill 72, and one jamb 70 are identical to that for the door frame 31*a*. Further, the port plates 110 for the door frame 31*b* are of the same structural concept as that for the door frame 31*a* with the exception that no centerpost 81 is used, and hence no hole 91 is required. However, the jamb 75 differs slightly in structural configuration from the other jamb 70, such being for the reason that the doors 20*b* of this module 14*b* are mounted so that the hinge line 23 is effectively coextensive with the side wall 22 plane of that module 14*b*. In this connection, and particularly with reference to FIG. 7, note that the jamb 75 defines an offset 112 adjacent the leading edge 113 thereof adapted to receive a hinge post 114 thereon. The hinge post 114 (like hinge post 94) is of a single length that extends from from the top to the bottom of each port, and is fixed to the jamb by rivets 117 intermediate the ends thereof. The post 114 includes a plurality of hinge blocks 118 thereon. This jamb 75 does include a tongue 77 which extends along the rear edge thereof in the same manner as for the jambs 70 in door frame 30*a*, as well as the joint connector 78 defined in the outer face of the jamb again in the same structural configuration and spatial location as provided on the exterior face of the jamb 70 for the door frame 30*a*. Thus, the door frame 30*b* is assembled with the casing 30*b* in the same manner as was the case with the door frame 31*a* and the casing 30*a*.

Figure 10:
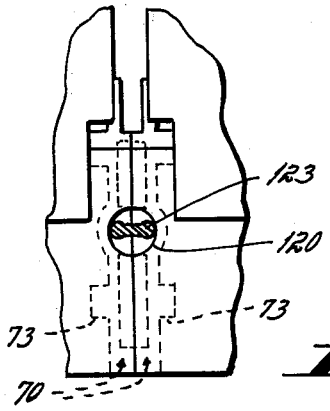
FIG. 10 is a blown-up and fragmented top view of the joint between two adjacent modules.

As previously mentioned each of the types of modules 14*a* and 14*b* is fabricated either in accord with the structural principles disclosed in FIGS. 2, 4 and 6, or with the structural principles disclosed in FIGS. 3, 5 and 7. After the modules 14*a* and 14*b* are so constructed, same are stacked in columnar fashion 11–13 as illustrated in FIG. 1, and the columns are disposed adjacent relative one to the other in matrix-like fashion also as illustrated in FIG. 1. In this attutide, the latch grooves 78 on the exterior surfaces of adjacent jambs 70, 75 define a common through bore 120 that runs from top 121 to bottom 122 of each column 12 having a column 11, 13 adjacent to it on each side. This bore 120 is of a dog-bone shape cross section as illustrated in FIG. 10. A similarly dog-bone shaped bolt 123 is then slid downwardly through the dog-bone shaped bore 120 so defined, thereby locking adjacent columns 11, 12 and 12, 13 of modules 14*a*, 14*b* together in matrix configuration. Of course, no locking means is required to positively connect an upper row module to a lower row module in the same column for the reason that gravity insures same will not become separated as long as same are maintained in vertical alignment by the dog-bone shaped bolt 123. This bolt 123, as is apparent from FIGS. 1 and 10, is hidden from view from the face of the matrix system as same is recessed behind leading edges 76 of the jamb 70, and those leading edges 76 are configured so as to be flush one with the other upon assembly of the system.

There are a couple of very practical advantages to the novel improved modular safety deposit box system 10 of this invention, and to the novel safety deposit box modular structure which permits implementation of that system. First, and in connection with manufacture of such boxes, the basic casing 30 structure is common to all embodiments of the safety deposit box module, i.e., the same basic casing structure is used for all modules A–M. Thus, the casing 30 can be tailored as dictated by the customer's requirements to size of box compartments 19 simply by installing one or more shelves 50, and vertical partitions 51, depending on the size of compartments desired. Second, the door frame 31 structure adapted to be connected with the casing 30 is prefabricated at the production site, i.e., is not fabricated at the installation site. This permits the doors 20 themselves to be plumbed and adjusted at the production site, thereby reducing the need for skilled personnel at the installation site. The door frame's jamb 70 structure also provides a rigid framework (which is required for useful life purposes in connection with the doors), and a unique structural means by which same may be assembled with a less heavy duty casing 30 (the function of which is only to support the safety deposit boxes in spaced configuration). Of course, the permanent interconnection of the frame 31 with the casing 30 assures the independent integrity of each box compartment 19 relative to every other box compartment within the module. The dog-bone bolt 123 type connector, which assures permanent and rigid connection between adjacent columns of the safety deposit box modules 14, is easily installed by unskilled labor at an on-site location. Indeed, the only installation required at the on-site location is that of locating the modules 14 in suitable position within the matrix, and then installing of the dog-bone bolts 123.

Having described in detail the preferred embodiment of my invention, what I desire to claim and protect by Letters Patent is:

1. A safety deposit box structure comprising a casing defining side, top, bottom and rear walls, at least one shelf mounted in said casing for defining a plurality of box compartments within said casing, a door frame for said casing, said door frame being comprised of a header, a sill and opposed jambs, said door frame components being structurally rigid, said door frame components being fixedly connected together into a structurally rigid frame configuration, and said door frame being sized to permit connection of said jambs with opposed side walls of said casing and to permit connection of said header and sill with said casing's top and bottom walls respectively, at least one port plate positioned between jambs of said door frame, said port plate defining a number of access ports in said door frame equal in number to the number of box compartments defined in said casing, and each port plate cooperating with a shelf to extend said shelf to adjacent the leading edge of said door frame, a hinge post fixedly connected to said door frame, and at least one strike plate defined in at least one jamb of said door frame, a plurality of doors mounted in hinged relation on said hinge post, a single door being adapted to serve as a closure for each of said access ports defined in said door frame, at least one lock mounted on each door, said lock including a retractable bolt adapted to cooperate with said strike plate for locking that door in a closed relation with said door frame, and connector means positively connecting said rigid door frame to said casing.

2. A safety deposit box structure as set forth in claim 1 including latch structure provided on the exterior surface of each jamb of said door frame, said latch structure cooperating with similar latch structure provided on an adjacent similar safety deposit box structure when said box structures are in matrix configuration to restrain said box structures in said matrix configuration one with the other.

3. A safety deposit box structure as set forth in claim 2, said latch structure on each jamb including a groove extending from the top end to the bottom end of said jamb, said groove being parallel to the plane of said door frame, and each groove being adapted to cooperate with an adjacent groove of a similarly adjacent safety deposit box structure when said boxes are in matrix configuration to define a throughbore, and a bolt received in connected relation with said groove, adjacent safety deposit box structure for restraining said boxes in connected relation.

4. A safety deposit box structure as set forth in claim 2, said door frame jambs being structured to eliminate said groove and bolt structure from a viewer's line of sight when said box structure is viewed from a line of sight substantially normal to the face of said box structure, and when two similar box structures are in connected relation one with the other through use of said latch structure.

5. A safety deposit box structure as set forth in claim 1 including tab structure on one of said shelf and casing side walls, and slot structure on the other of said shelf and casing side walls, said shelf and casing side walls being connected in erected relation with said casing side walls through said tab and slot structure.

6. A safety deposit box structure as set forth in claim 1 including at least one vertical divider connected to said casing for defining a plurality of box compartments there within, each of said compartments at least partially defined by said vertical divider being of a width about one-half of the width of said casing, and said hinge post being mounted between said header and sill in a position parallel to said jambs and about midway therebetween, said hinge post thereby being centrally mounted substantially coplanar with said vertical divider.

7. A safety deposit box structure as set forth in claim 6 including first tab structure on one of said shelf and casing side walls, and first slot structure on the other of said shelf and casing side walls, said shelf and casing side walls being connected in erected relation with said casing side walls through said first tab and slot structure, and second tab structure on one of said vertical divider and said casing top and bottom walls, and second slot structure on the other of said vertical divider and said casing top and bottom walls, said vertical divider being connected in erected relation with one of said casing top and bottom walls through said second tab and slot structure.

8. A safety deposit box structure as set forth in claim 6 including at least one strike plate defined in each jamb of said door frame, said doors all being mounted on said center hinge post, the lock on at least one of said doors being adapted to cooperate with that strike plate on one of said jambs and the lock on at least one other of said doors being adapted to cooperate with that strike plate on the other of said jambs.

9. A safety deposit box system in which adjacent safety deposit box modules are connected one with the other in a matrix configuration, said system comprising at least two safety deposit box modules positioned side-by-side adjacent one to the other on a bottom row, and at least two safety deposit box modules positioned side-by-side adjacent one to the other on a top row, one of said top row modules being positioned above one of said bottom row modules in a first column and the other of said top row modules being positioned above the other of said bottom row modules in a second column, thereby positioning said modules in a matrix configuration, a door frame jamb adjacent the front face of each of said modules, said jambs on adjacent modules being adjacent one to the other, groove structure defined on adjacent door frame jambs of adjacent modules, said groove structure on adjacent jambs cooperating one with another to define a throughbore between adjacent modules in adjacent columns, and said throughbore being vertically oriented to run between all adjacent modules in adjacent columns, and a dead bolt received longitudinally within said throughbore, said dead bolt being laterally restrained within said vertically oriented throughbore by said groove structure on adjacent modules upon assembly therewith, said dead bolt and said throughbore cooperating to restrain said adjacent modules in adjacent columns in connected relation one with the other in said matrix configuration, and said dead bolt and said throughbore cooperating to restrain said top row module and said bottom row module within the same column in column relation one with the other in said matrix configuration.

10. A safety deposit box system as set forth in claim 9, said door fram jambs being structured to eliminate said groove and bolt structure from a viewer's line of sight when said box system is viewed from a line of sight substantially normal to the face of said box system.

11. A safety deposit box system as set forth in claim 9, said groove structure on each jamb including a continuous groove extending from the top end to the bottom end of said jamb.

* * * * *